US008287968B2

(12) United States Patent
Goto et al.

(10) Patent No.: US 8,287,968 B2
(45) Date of Patent: Oct. 16, 2012

(54) COATING FILM AND COATING-FILM FORMING METHOD

(75) Inventors: Akihiro Goto, Tokyo (JP); Masahiro Okane, Tokyo (JP); Kazushi Nakamura, Tokyo (JP); Hiroyuki Teramoto, Tokyo (JP); Hiroyuki Ochiai, Tokyo (JP); Mitsutoshi Watanabe, Tokyo (JP)

(73) Assignees: Mitsubishi Electric Corporation, Tokyo (JP); Ihi Corporation, Tokyo (JP)

( * ) Notice: Subject to any disclaimer, the term of this patent is extended or adjusted under 35 U.S.C. 154(b) by 938 days.

(21) Appl. No.: 12/296,179

(22) PCT Filed: Apr. 5, 2006

(86) PCT No.: PCT/JP2006/307250

§ 371 (c)(1), (2), (4) Date: Jan. 23, 2009

(87) PCT Pub. No.: WO2007/113914

PCT Pub. Date: Oct. 11, 2007

(65) Prior Publication Data

US 2010/0016185 A1 Jan. 21, 2010

(51) Int. Cl.
*H01T 14/00* (2006.01)
*B32B 15/00* (2006.01)

(52) U.S. Cl. ..... 427/580; 428/615

(58) Field of Classification Search ..... 427/580; 428/615

See application file for complete search history.

(56) References Cited

U.S. PATENT DOCUMENTS

| | | | | |
|---|---|---|---|---|
| 2005/0211165 | A1 | 9/2005 | Goto et al. | |
| 2006/0035068 | A1 * | 2/2006 | Ochiai et al. | 428/306.6 |
| 2006/0081462 | A1 * | 4/2006 | Goto et al. | 204/280 |

FOREIGN PATENT DOCUMENTS

| | | | |
|---|---|---|---|
| EP | 1544321 | A1 | 6/2005 |
| WO | 2004/011696 | A1 | 2/2004 |
| WO | 2004/029329 | A1 | 4/2004 |
| WO | WO 2004108989 | A1 * | 12/2004 |
| WO | 2005/068670 | A1 | 7/2005 |

* cited by examiner

*Primary Examiner* — Dah-Wei Yuan
*Assistant Examiner* — Nga Leung V Law
(74) *Attorney, Agent, or Firm* — Sughrue Mion, PLLC

(57) ABSTRACT

To form a coating film having an excellent wear-resistant property in a temperature range from low temperature to high temperature a coating-film forming method includes a metal-powder producing step of producing a metal powder containing an element exhibiting a lubricating property when oxidized; an oxidizing step of oxidizing the metal powder so that an amount of oxygen contained in the metal powder is within 6 weight % to 14 weight %; and a coating-film forming step of forming a coating film on a material subject to a treatment, the coating film having such a composition that an area where an oxygen content is 3 weight % or less and an area where an oxygen content is 8 weight % or more are distributed in a unit area of the coating film when the metal powder is in a melted state or a semi-melted state, and an oxygen content of the entire coating film after the metal powder is melted or semi-melted being within 5 weight % to 9 weight %.

9 Claims, 13 Drawing Sheets

FIG.10

| POWDER | | RESULT OF ANALYSIS OF COATING FILM | | | | | |
|---|---|---|---|---|---|---|---|
| USED POWDER | AMOUNT OF OXYGEN (wt%) | C | O | Cr | Co | Ni | W |
| No.1 | 13.0 | 1.3 | 7.1 | 25.8 | 50.0 | 9.1 | 6.9 |
| No.2 | 10.4 | 1.4 | 6.5 | 25.2 | 50.2 | 9.6 | 7.1 |
| No.3 | 10.4 | 1.4 | 6.5 | 25.3 | 49.7 | 9.5 | 7.6 |
| No.4 | 13.0 | 1.7 | 8.1 | 27.8 | 47.3 | 8.4 | 6.7 |
| No.5 | 10.4 | 1.4 | 5.9 | 25.2 | 51.2 | 9.0 | 7.4 |
| No.6 | 10.4 | 2.0 | 5.8 | 25.4 | 49.6 | 9.1 | 8.0 |

COATING FILM AND COATING-FILM FORMING METHOD

TECHNICAL FIELD

The present invention relates to a coating film and a coating-film forming method. The present invention more particularly relates to a coating film having an excellent wear resistance in a wide temperature range from a low temperature to a high temperature and a method of forming the coating film.

BACKGROUND ART

Conventionally, to provide a wear-resistant property to a metal, there has been widely used a technique of forming a coating film made of other metal material, ceramics, or the like on the surface of the metal. In general, such metals with a wear-resistant coating film are used under a temperature environment in a range from room temperature to about 200° C., and in most cases, used in an environment where there is oil as a lubricant. However, oil cannot be used everywhere. For example, oil cannot be used in aircraft engines inside of which the temperature ranges from room temperature to as high as about 1000° C. For materials used in such environments, therefore, it is necessary to exploit the material's wear-resistant property that comes from the material's inherent strength and lubricating performance.

FIG. 12-1 shows an example in which a wear-resistant coating film is formed on an aircraft gas turbine engine as one example. FIG. 12-2 is an enlarged view of a low-pressure turbine blade 802 of a low-pressure turbine 801 in the gas turbine engine shown in FIG. 12-1. FIG. 12-3 is a further enlarged view of a portion 803 of the low-pressure turbine blade 802 shown in FIG. 12-2, and shows a situation that a wear-resistant material is welded to a portion, which is referred to as an interlocking portion 804, of the low-pressure turbine blade 802 where turbine blades are interconnected to each another. Practically, the low-pressure turbine blade 802 is used after the welded portion is made into a flat surface by grinding.

On the other hand, there are disclosed technologies for forming a wear-resistant coating film with methods other than the welding. For example, there is disclosed such a technology that a coating film made from an electrode material is formed by generating a pulsed discharge between a powder compact and a material subject to a treatment (see Patent document 1 and Patent document 2). These Patent document 1 and Patent document 2 teach to mix an oxide into an electrode to solve the problem of wear resistance in an intermediate temperature range that is a problem of the conventional coating film described above.

Patent document 1: International Publication No. WO 2004/029329 pamphlet

Patent document 2: International Publication No. WO 2005/068670 pamphlet

Patent document 3: International Publication No. WO 2004/011696 pamphlet

DISCLOSURE OF INVENTION

Problem to be Solved by the Invention

However, a study by the inventors of the present patent application has found that although a conventionally-used wear-resistant material exhibits sufficient wear-resistant performance in a low temperature range (about 300° C. or less) and a high temperature range (about 700° C. or more), their wear-resistant performance is insufficient in an intermediate temperature range (from about 300° C. to about 700° C.).

FIG. 13 is a characteristic diagram showing a relation between temperature and wear amount of a test specimen when a sliding test was conducted. In the sliding test, first, as shown in FIG. 14, test specimens (an upper test specimen 813*a* and a lower test specimen 813*b*) that a cobalt (Co) alloy metal 811 as a conventional wear-resistant material is welded to a test-specimen main body 812 by TIG (tungsten inert gas) welding were prepared. Then, the upper test specimen 813*a* and the lower test specimen 813*b* were arranged so that coating films 811 are opposed to each other. A load was applied to each of the upper test specimen 813*a* and the lower test specimen 813*b* so that a surface pressure is between 3 MPa (magapascal) and 7 MPa, and in this state, the upper test specimen 813*a* and the lower test specimen 813*b* were slid by 0.5 mm (millimeter) in width in a reciprocating manner in a direction X shown in FIG. 14 through $1\times10^6$ cycles of slide at a frequency of 40 Hz (hertz). Incidentally, after the Co alloy metal was welded to the test-specimen main body 812, the welded portion was ground so that a surface of the Co alloy metal 811 is flattened.

In the characteristic diagram shown in FIG. 13, a horizontal axis indicates a temperature of the atmosphere where the sliding test was conducted. The test was conducted under a temperature in a range from room temperature to about 900° C. A vertical axis of the characteristic diagram indicates a total sum of wear amounts of the upper and lower test specimens 813*a* and 813*b* after the sliding test (after $1\times10^6$ cycles of slide). Incidentally, the sliding test was conducted in an unlubricated condition, i.e., in a condition that no lubricating oil is supplied.

The characteristic diagram shown in FIG. 13 shows that even though the Co alloy metal is conventionally used as a wear-resistant material, a wear amount in an intermediate temperature range is high. The material used in this test was a Co-base alloy material containing Cr (chromium), Mo (molybdenum), and Si (silicon).

The above description is based on a result of the test with the material made by the welding. Furthermore, another test by the inventors has found that in a coating film formed by the technology with a pulsed discharge, as disclosed in Patent document 1, Patent document 3, or the like, a wear amount in an intermediate temperature range is high in much the same way.

As disclosed in Patent document 1, a reason for high wear amount in an intermediate temperature range is as follows. Namely, in the high temperature range, Cr or Mo contained in the material is oxidized due to exposure to a high-temperature environment, and chromium oxide or molybdenum oxide that has a lubricating property is produced, whereby the material exhibited lubricating property and the wear amount was decreased. On the other hand, in the low temperature range, the material had a strength because the temperature was low, so that the wear amount was low because of the strength. In contrast, in the intermediate temperature range, the material did not exhibit lubricating property caused by the oxide as described above, and also the strength of the material was weak because the temperature is relatively high. Thus, the wear resistance was decreased, and the wear amount was increased.

On the other hand, Patent document 2 discloses the method of mixing an oxide into an electrode to improve the wear-resistant performance in the intermediate temperature range. In this case, the wear-resistant performance in the intermediate temperature range can be improved; however, there are such problems that the strength of the coating film is decreased because the oxide is mixed into the electrode and the wear-resistant performance in the low temperature range is decreased.

The present invention has been made in view of the above matters, and an object of the present invention is to achieve a coating film having an excellent wear resistance in a temperature range from low temperature to high temperature and a method of forming the coating film.

Means for Solving Problem

To solve the above problems and to achieve the above object, a coating-film forming method according to the present invention includes a metal-powder producing step of producing a metal powder containing an element exhibiting a lubricating property when oxidized; an oxidizing step of oxidizing the metal powder so that an amount of oxygen contained in the metal powder is within 6 weight % to 14 weight %; and a coating-film forming step of forming a coating film on a material subject to a treatment, the coating film having such a composition that an area where an oxygen content is 3 weight % or less and an area where an oxygen content is 8 weight % or more are distributed in a unit area of the coating film when the metal powder is in a melted state or a semi-melted state, and an oxygen content of the entire coating film after the metal powder is melted or semi-melted being within 5 weight % to 9 weight %.

Effect of the Invention

A coating-film forming method according to the present invention makes it possible to form a coating film having an excellent wear-resistant property in a temperature range from low temperature to high temperature without affecting a strength of the coating film.

BRIEF DESCRIPTION OF DRAWINGS

FIG. 5-1 is a characteristic diagram showing a relation between electrical resistance and wear amount of a test specimen those obtained when a sliding test was conducted with a coating film formed by a plurality of electrodes having a different surface electrical resistance from one another.

FIG. 5-2 is a diagram showing a test specimen in which a coating film according to the present embodiment is welded to a test-specimen main body by TIG welding.

FIG. 7-1 is a diagram showing an example of parameters of a discharge pulse used in the discharge surface treatment, and a diagram showing a voltage waveform of a voltage applied to between an electrode and a work at the time of discharge.

FIG. 7-2 is a diagram showing an example of parameters of a discharge pulse used in the discharge surface treatment, and a diagram showing a current waveform of a current flown at the time of discharge.

FIG. 10 is a diagram showing an example of data of measurements of an amount of oxygen contained in a Co alloy powder and an amount of oxygen (and other elements) contained in a coating film formed by an electrode molded from the Co alloy powder.

FIG. 11-1 is a diagram showing a test specimen in which a coating film according to the present embodiment is welded to a test-specimen main body by TIG welding.

FIG. 11-2 is a characteristic diagram showing a relation between temperature of the atmosphere and wear amount of the test specimen those obtained when a sliding test was conducted with a wear-resistant coating film according to the present embodiment.

FIG. 12-1 is a diagram showing a state where a wear-resistant coating film is formed on an aircraft gas turbine engine.

FIG. 12-2 is an enlarged view of a low-pressure turbine blade of a low-pressure turbine in the gas turbine engine shown in FIG. 12-1.

FIG. 12-3 is a further enlarged view of a portion of the low-pressure turbine blade shown in FIG. 12-2, and a diagram showing a state where a wear-resistant material is welded to an interlocking portion of the low-pressure turbine blade.

EXPLANATIONS OF LETTERS OR NUMERALS

Figure 1:
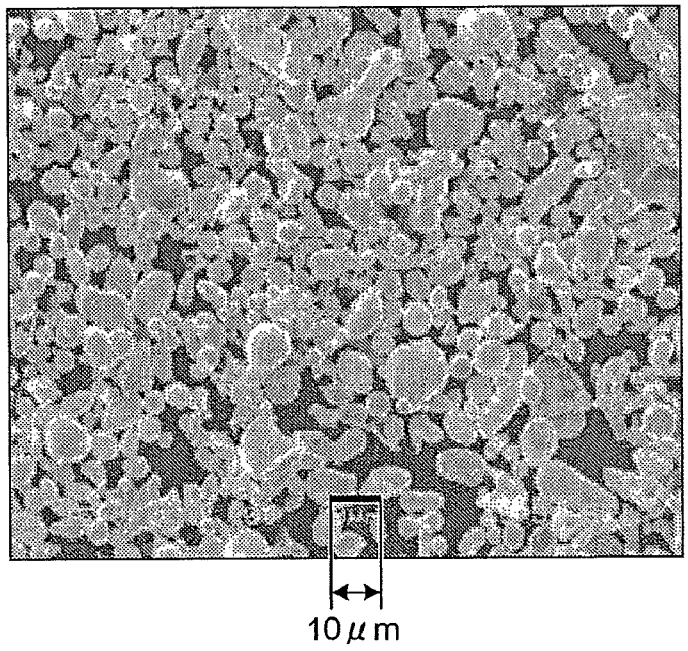
FIG. 1 is an photograph showing a state of a powder according to the present embodiment after the powder is classified.

101 grinding chamber
102 feeder
103 raw powder
104 powder
105 filter
201 alloy powder
202 upper punch
203 lower punch
204 die
251 coating film
252 test-specimen main body
253*a* upper test specimen
253*b* lower test specimen
301 electrode
302 work
303 working fluid
304 discharge-surface-treatment power supply
305 arc column
401 hole
402 portion where a concentration of oxygen is high
403 unit area
404 oxygen-poor portion
501 coating film
502 test-specimen main body

503*a* upper test specimen
503*b* lower test specimen
801 low-pressure turbine
802 low-pressure turbine blade
803 portion of low-pressure turbine blade
804 interlocking portion
811 alloy metal
811 coating film
812 test-specimen main body
813*a* upper test specimen
813*b* lower test specimen

BEST MODE(S) FOR CARRYING OUT THE INVENTION

Exemplary embodiments of a coating film and a coating-film forming method according to the present invention are explained in detail below with reference to the accompanying drawings. Incidentally, the present invention is not limited to the following description, and various modifications and variations can be made without departing from the spirit and scope of the present invention accordingly. In the accompanying drawings, each of members may be illustrated not-to-scale in a way easy to understand.

Embodiment

First, a coating film according to a present embodiment is explained below. The coating film according to the present invention is characterized in that the coating film has such a composition that an area where an oxygen content is 3 weight % or less and an area where an oxygen content is 8 weight % or more are distributed in a unit area of the coating film that a metal powder made from a powder containing an element exhibiting a lubricating property by oxidation thereof is oxidized into a melted state or a semi-melted state, and an oxygen content of the entire coating film is 5 weight % to 9 weight %. The coating film according to the present embodiment having such a composition has both an excellent wear-resistant property in a temperature range from low temperature to high temperature and high strength.

A method of producing the coating film according to the present invention is explained below. First, to produce the coating film according to the present invention, a powder as a raw material is first produced by a water atomization method. In the present embodiment, there is explained such a case that a metal in which "25 weight % of chromium (Cr), 10 weight % of nickel (Ni), 7 weight % of tungsten (W), and cobalt (Co) for the rest" are mixed in this ratio is dissolved thereby producing a Co alloy powder by the water atomization method. The powder produced by the water atomization method contains powder particles of particle diameters over a wide range from a few μm (micrometers) to a few hundred μm. Therefore, the powder is classified to extract powder particles with average particle diameter of about 20 μm. FIG. 1 is a photograph showing a state of the powder after the classification. The powder after classification contains very little oxygen, i.e., 1% or less at the maximum.

In the present embodiment, the powder having the average particle diameter of about 20 μm is used. However, the average particle diameter of the powder is not limited to this particle diameter. Namely, it is possible to use a powder having an average particle diameter of more than 20 μm or a powder having an average particle diameter of less than 20 μm. However, the powder having the average particle diameter of more than 20 μm takes a longer time to grind the powder, as described later. On the other hand, the powder having the average particle diameter of less than 20 μm is so fine that only a small amount of the powder can be collected in the classification, which leads to cost increase.

Figure 2:
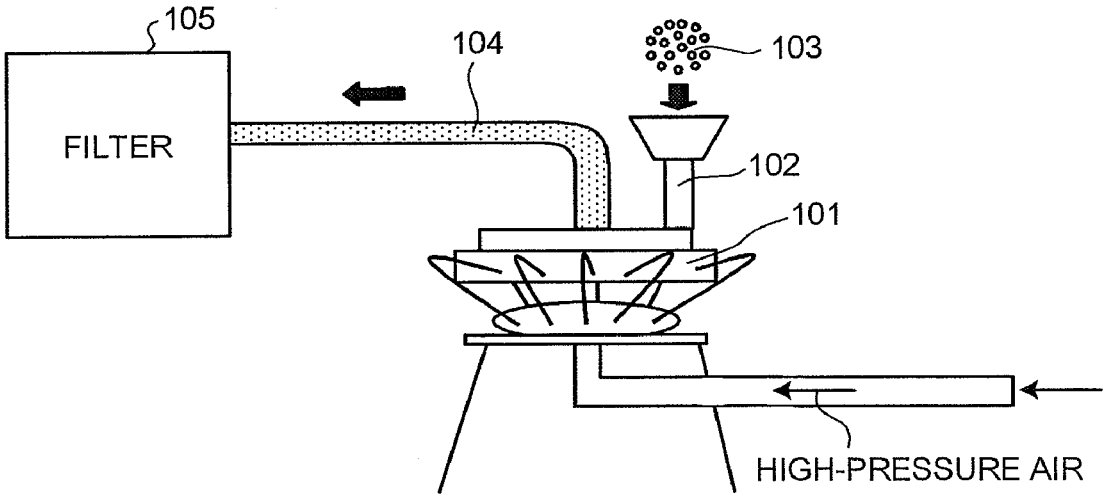
FIG. 2 is a schematic diagram showing an example of a configuration of a swirling jet mill according to the present embodiment.

A process of oxidizing the powder is explained below. In the present embodiment, as the process of oxidizing the powder, the powder is ground with a jet mill in the atmosphere, i.e., in an oxidant atmosphere. FIG. 2 is a schematic diagram showing an example of a configuration of a swirling jet mill. High-pressure air is supplied from an air compressor (not shown), and thereby creating a high-speed swirling airflow in a grinding chamber 101. Then, a feeder 102 supplies a raw powder 103 to the grinding chamber 101, and the powder is ground by the energy of the high-speed swirling airflow. Incidentally, such a swirling jet mill has been disclosed, for example, in Japanese Patent Application Laid-open No. 2000-42441, so that the detailed description is omitted here.

Air at the air pressure of about 0.5 MPa is used in typical swirling jet mills. However, the Co alloy powder used in the present embodiment, which is mixed with "25 weight % of Cr, 10 weight % of Ni, 7 weight % of W, and Co for the rest" in this ratio, cannot be ground by an air at such low air pressure. Therefore, air at a higher air pressure of about 1.0 MPa to 1.6 MPa is used in the present embodiment. A powder 104 that is ground and discharged from the jet mill is caught by a filter 105. If the powder is not fine enough, the powder in the filter 105 is again fed to the jet mill to be ground until the powder is ground finely.

Figure 3:
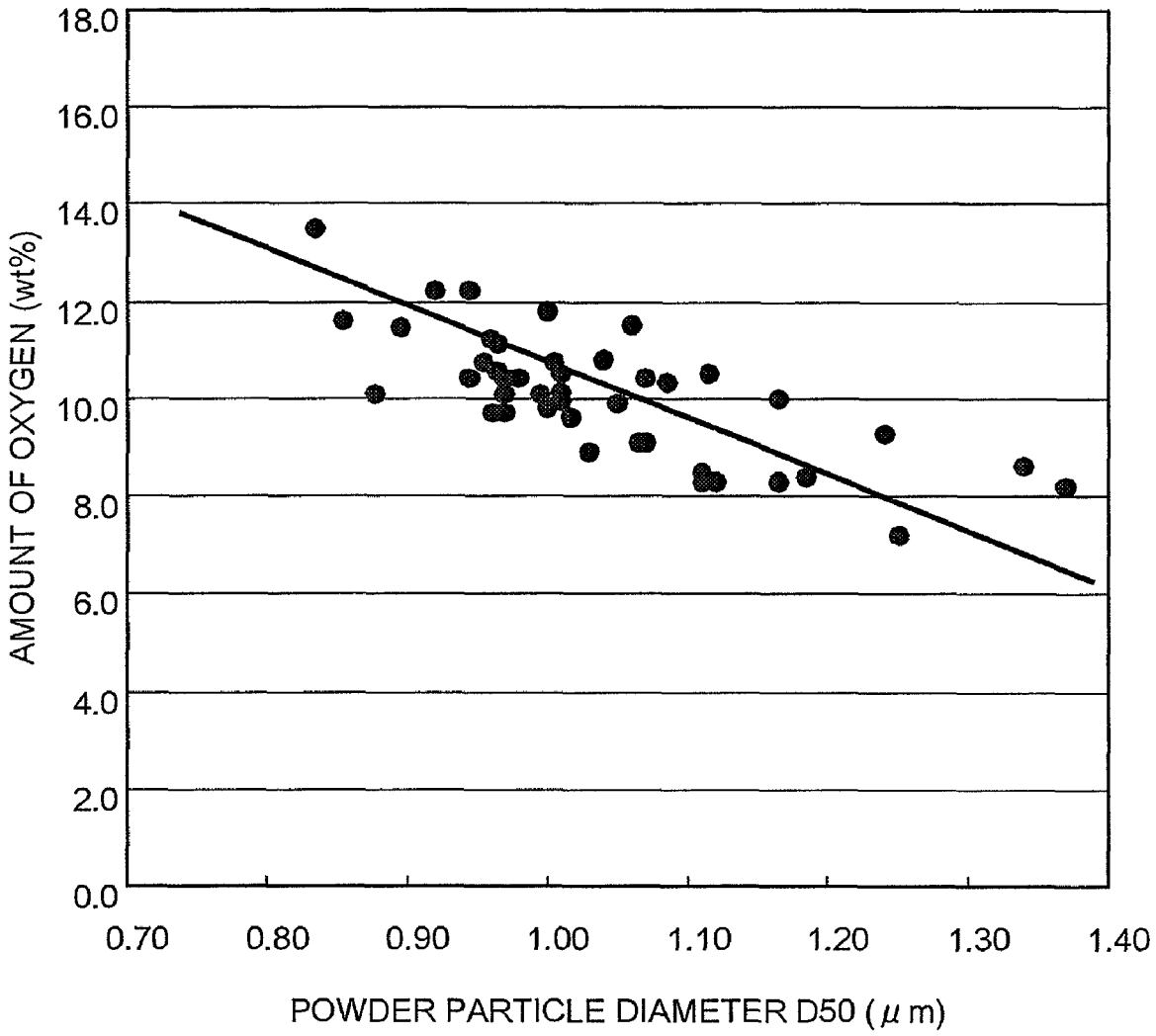
FIG. 3 is a characteristic diagram showing a relation between powder particle diameter of a powder according to the present embodiment and concentration of oxygen contained in the powder.

In the swirling jet mill, a particle diameter of the ground powder depends on the pressure of compressed air and the number of times of grinding. An experiment by the inventors showed that the amount of oxygen contained in the ground powder is very strongly correlated with the particle diameter of the powder. FIG. 3 is a characteristic diagram showing a relation between powder particle diameter and concentration of oxygen contained in a powder. A horizontal axis indicates average particle diameter of a powder (D50 as a particle diameter of a powder corresponding to 50% by volume). On the other hand, a vertical axis indicates concentration (weight %) of oxygen contained in the powder. The average particle diameter of the powder is measured with a particle-size distribution measuring apparatus manufactured by Microtrac, Inc. On the other hand, the concentration (weight %) of oxygen is measured with EPMA (Electron Probe Micro-Analysis).

To have better wear resistance, as described later, it was found that the amount of oxygen contained in the powder needs to be in a range of about 6 weight % to about 14 weight %. If the amount of oxygen contained in the powder exceeds this range, the strength of the formed coating film decreases. Especially, when the amount of oxygen contained in the powder exceeds 20 weight %, it becomes extremely difficult to uniformly-mold the powder in a subsequent molding process. On the other hand, if the amount of oxygen contained in the powder is lower than 6 weight %, the formed coating film is inferior in the wear resistance, and it is difficult to reduce wear in an intermediate temperature range like the conventional technology.

Figure 4:
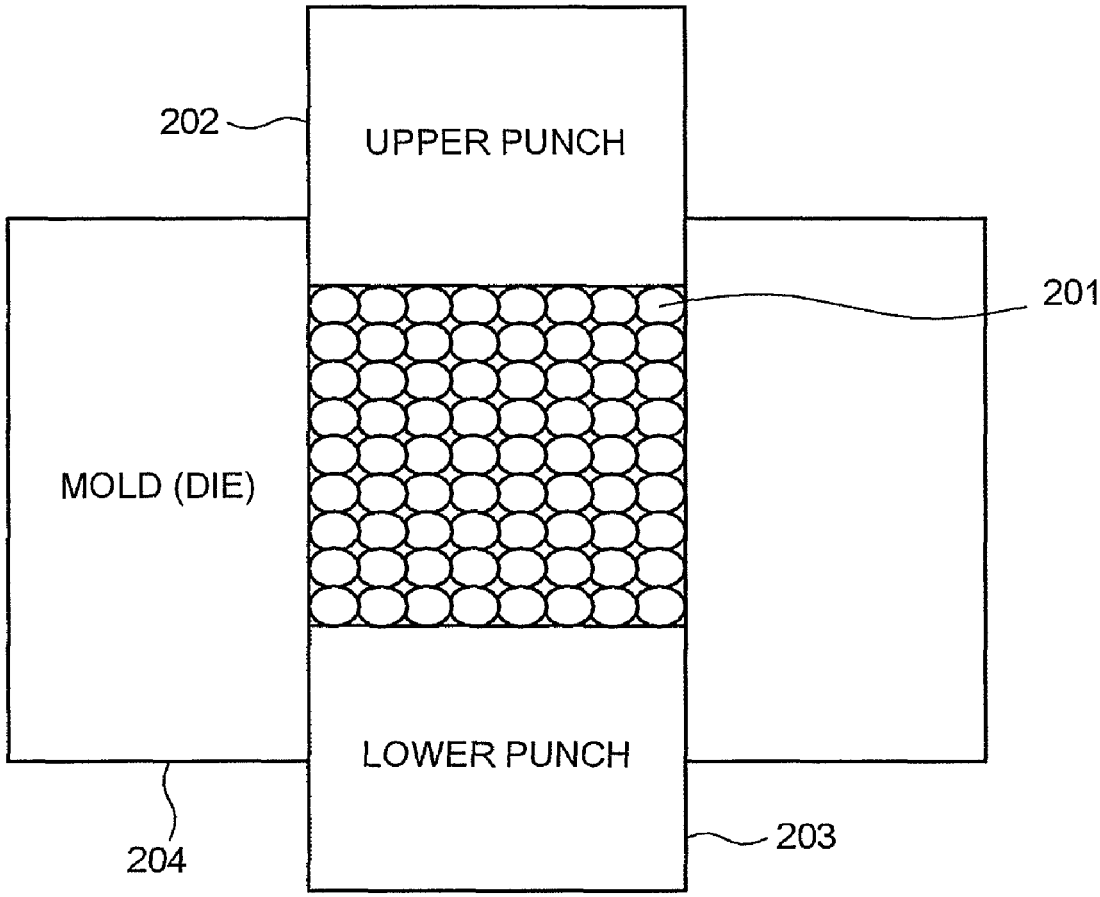
FIG. 4 is a cross-sectional view for explaining a concept of a process of molding a powder according to the present embodiment.

Subsequently, a process of molding the ground powder is explained below with reference to FIG. 4. FIG. 4 is a cross-sectional view for explaining a concept of the process of molding the powder according to the present embodiment. In FIG. 4, a space surrounded by a upper punch 202 of a mold, a lower punch 203 of the mold, and dies 204 of the mold is filled with a Co alloy powder 201 mixed with Co, Cr, and Ni that is ground in the grinding process and contains about 10 weight % of oxygen. Then, the Co alloy powder 201 is compression molded, and thereby forming a green compact. In a discharge surface treatment as described later, the green compact is used as a discharge electrode.

Although a press pressure for molding the powder differs depending on a size of a compact, it is assumed that the press pressure is within a range of about 100 MPa to 300 MPa and a heating temperature is within a range of 600° C. to 800° C. At the time of pressing, to improve the moldability of the powder, 5 weight % to 10 weight % of wax is mixed in the powder with respect of a weight of the powder. The wax will be removed in a subsequent heating process.

The compact produced in this manner is used as an electrode in the subsequent discharge surface treatment. The compact crumbles due to a pulsed discharge energy, as described later, and melted into a coating film. Therefore, as the electrode, how easily the compact can crumble due to the discharge becomes important. In such an electrode, an appropriate value of resistance of an electrode surface, which is measured by a four-probe method defined in JIS K 7194, is within a range of $5\times10^{-3}\Omega$ (ohm) to $10\times10^{-3}\Omega$, and more preferably within a range of $6\times10^{-3}\Omega$ to $9\times10^{-3}\Omega$.

Figures 1, 5:
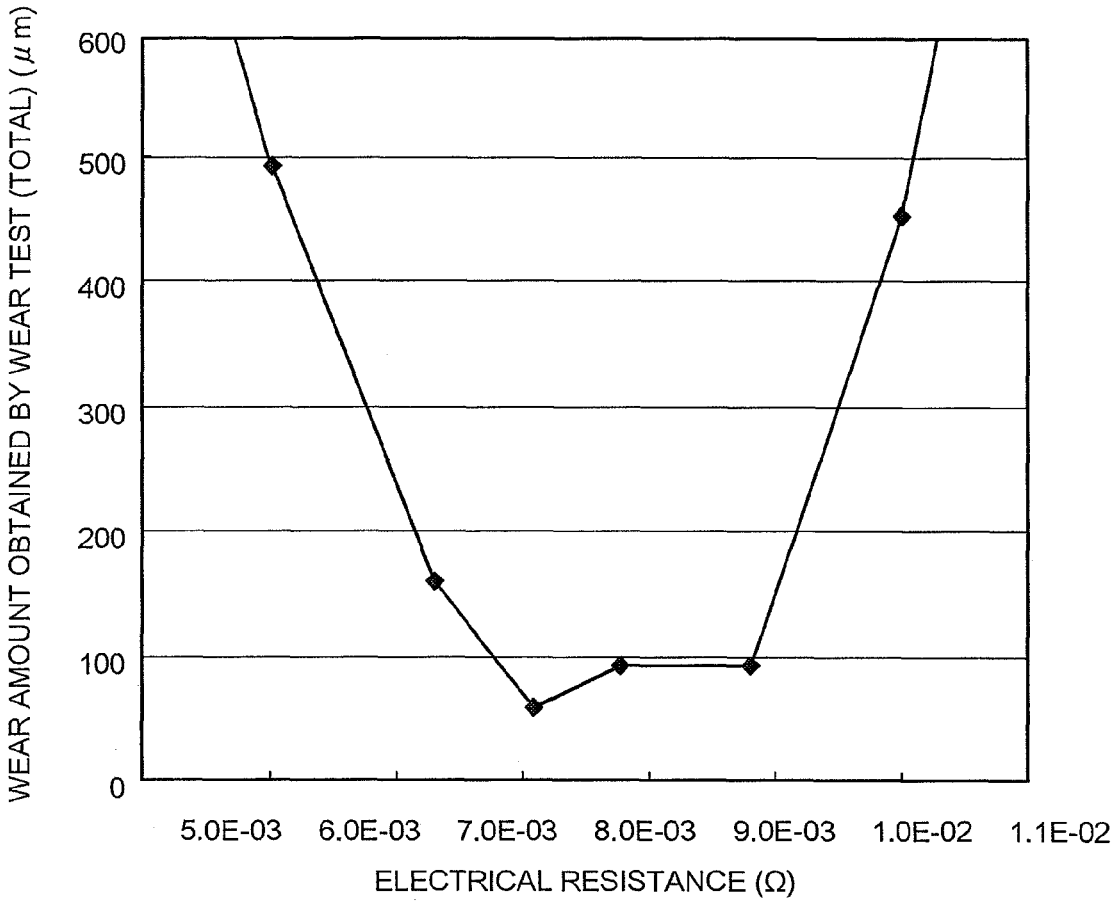
Figures 2, 5:
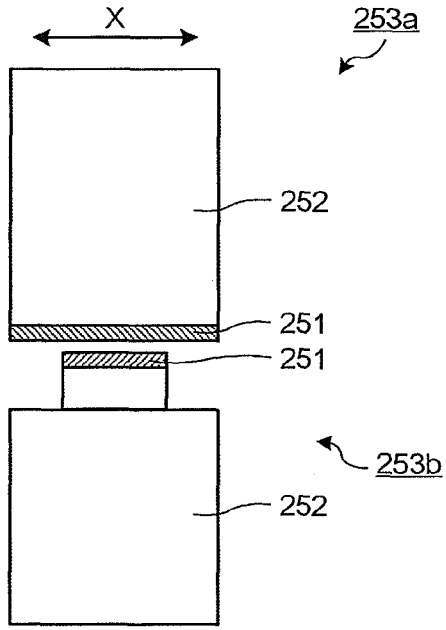

FIG. 5-1 shows a result of a sliding test with a coating film that was formed by a discharge surface treatment method, as described later, with a plurality of electrodes that was produced as described above and a resistance of an electrode surface of which is different from one another. In FIG. 5-1, a horizontal axis indicates resistance (Ω) of an electrode surface, and a vertical axis indicates wear amount of the electrode. As a test specimen, as shown in FIG. 5-2, test specimens (an upper test specimen 253*a* and a lower test specimen 253*b*) that a coating film 251 is welded to a test-specimen main body 252 by TIG welding were prepared.

Then, the upper test specimen 253*a* and the lower test specimen 253*b* were arranged so that the coating films 251 of which are opposed to each other. The test was conducted under such conditions that a load was applied to each of the upper test specimen 253*a* and the lower test specimen 253*b* so that a surface pressure of which is 7 MPa, and the upper test specimen 253*a* and the lower test specimen 253*b* were slid by 0.5 mm in width in a reciprocating manner in a direction X shown in FIG. 5-2 through $1\times10^{6}$ cycles of slide at a frequency of 40 Hz. Incidentally, after each of the coating films was welded to the corresponding test-specimen main body 252, the welded portion was ground so that a surface of the coating film 251 is flattened.

As can be seen from FIG. 5-1, for electrodes having a resistance of an electrode surface in the range of $5\times10^{-3}\Omega$ to $10\times10^{-3}\Omega$ the wear amount was low. Especially, for electrodes having a resistance of an electrode surface in the range of $6\times10^{-3}\Omega$ to $9\times10^{-3}\Omega$ the wear amount was significantly low. Therefore, as an electrode to be used in the present embodiment, an appropriate value of resistance of an electrode surface, which is measured by the four probe method defined in JIS K 7194, is within the range of $5\times10^{-3}\Omega$ to $10\times10^{-3}\Omega$, and more preferably within the range of $6\times10^{-3}\Omega$ to $9\times10^{-3}\Omega$.

Incidentally, as parameters for the discharge surface treatment applied in the sliding test, there are such parameters that, as shown in a waveform in FIG. 8 as described later, a current with a narrow width and a high peak is added to a discharge pulse period, a current value of a portion of the high peak is about 15 amperes (A), a current value of a portion of a low current is about 4 A, and a discharge duration time (a discharge pulse width) is about 10 μs.

Figure 6:
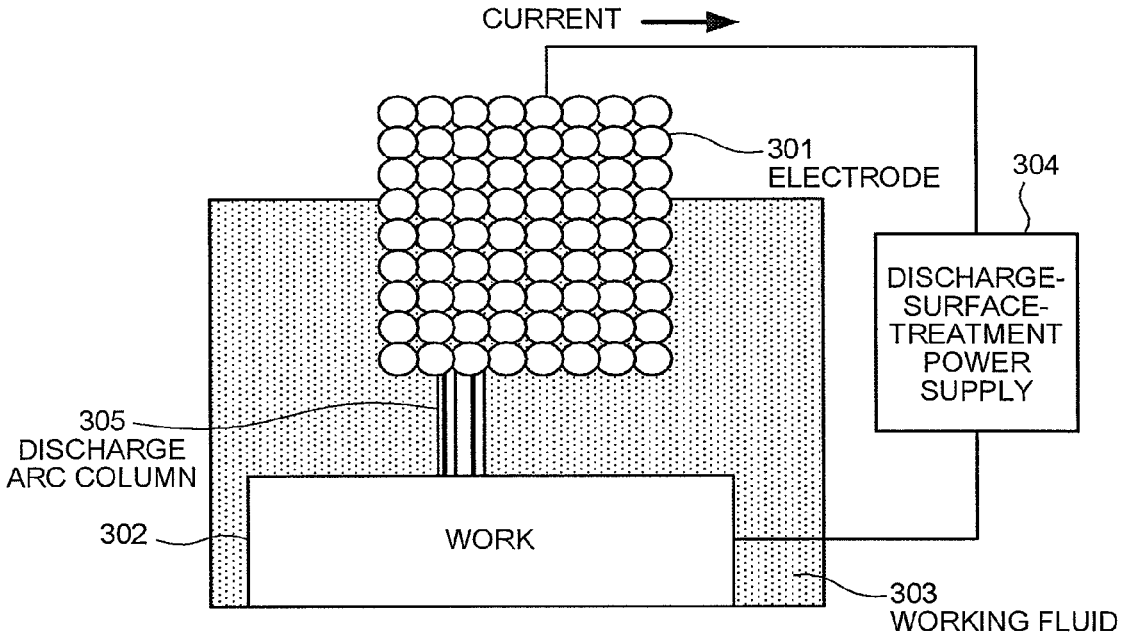
FIG. 6 is a schematic diagram showing a schematic configuration of a discharge surface treatment apparatus that performs a discharge surface treatment in the present embodiment.

Subsequently, a coating film is formed on a material subject to the treatment (a work) by the discharge surface treatment method by using the electrode produced in this manner. FIG. 6 is a schematic diagram showing a schematic configuration of a discharge surface treatment apparatus that performs a discharge surface treatment in the present embodiment. As shown in FIG. 6, the discharge surface treatment apparatus according to the present embodiment includes an electrode 301 composed of the Co alloy powder described above, oil as a working fluid 303, a working-fluid supplying device (not shown) that dips the electrode 301 and a work 302 into the working fluid or supplies the working fluid 303 to a portion between the electrode 301 and the work 302, and a discharge-surface-treatment power supply 304 that generates a pulsed discharge (an arc column 305) by applying a voltage to the portion between the electrode 301 and the work 302. Incidentally, in FIG. 6, description of members not directly related to the present invention, such as a drive unit that controls relative positions of the discharge-surface-treatment power supply 304 and the work 302, is omitted.

To cause the discharge surface treatment apparatus to form a coating film on a surface of the work, the electrode 301 and the work 302 are arranged in the working fluid 303 to be opposed to each other, and the discharge-surface-treatment power supply 304 generates a pulsed discharge at the portion between the electrode 301 and the work 302. Then, a coating film made from an electrode material is formed on the surface of the work by a discharge energy of the pulsed discharge, or a coating film made from a material to which an electrode material is reacted is formed on the surface of the work by a discharge energy of the pulsed discharge. Such an electrode that the side of the electrode 301 is a negative electrode and the side of the work 302 is a positive electrode is used. As shown in FIG. 6, the arc column 305 due to the discharge is generated between the electrode 301 and the work 302.

Figures 1, 7:
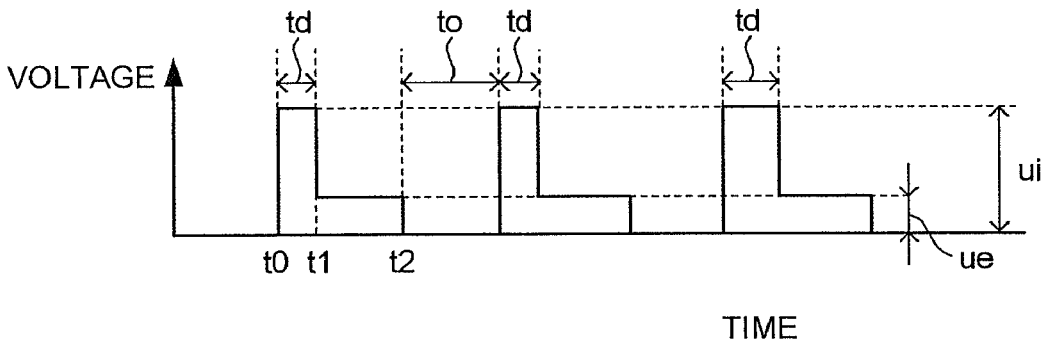
Figures 2, 7:
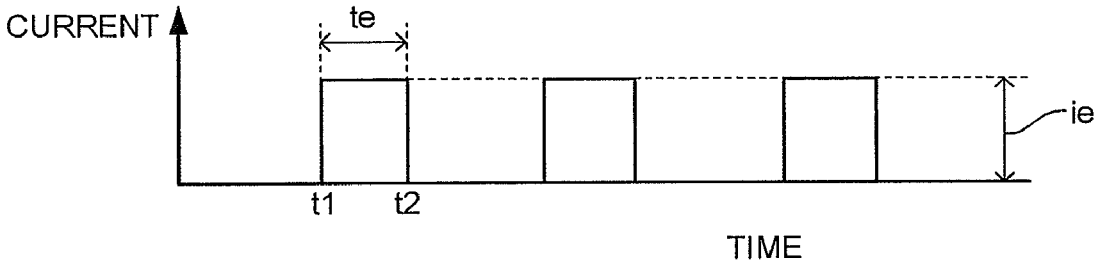

The discharge surface treatment is performed with the green compact electrode produced under the above conditions, and thereby forming the coating film. FIGS. 7-1 and 7-2 respectively show an example of a discharge pulse used in the discharge surface treatment. FIGS. 7-1 and 7-2 are diagrams showing the example of parameters of the discharge pulse. Specifically, FIG. 7-1 shows a voltage waveform of a voltage applied to between the electrode and the work at the time of discharge, and FIG. 7-2 shows a current waveform of a current flown at the time of discharge.

As shown in FIG. 7-1, a no-load voltage ui is applied to both the electrodes at a time point t0. At a time point t1 after a lapse of a discharge delay time td, a current starts flowing into the both electrodes, and the discharge is started. A voltage at this time is a discharge voltage ue, and a current flown at this time is a peak current value ie. Then, when the supply of the voltage to both the electrodes is stopped at a time point t2, no current is flown.

A time difference t2–t1 corresponds to a pulse width te. A voltage is applied to both the electrodes in such a manner that a voltage waveform in the time period t0 to t2 is repeated at intervals of a quiescent time period to. In other words, as shown in FIGS. 7-1, a pulsed voltage is applied to between the electrode for the discharge surface treatment and the work.

In the present embodiment, as the parameters of a discharge pulse used in the discharge surface treatment, when a current waveform has a square-wave pattern as shown in FIG. 7-2, appropriate conditions are a peak current value ie=2 A to 10 A, and a discharge duration time (a discharge pulse width) te=5 μs to 20 μs; however, these ranges may get out before and after from each of the ranges depending on a crumbling degree of the electrode. Furthermore, to cause the electrode to crumble due to discharge pulse more effectively, it has been found that as shown in FIG. 8, a waveform in which a current with a narrow width and a high peak is added to a current in a discharge pulse period is effective. In the voltage waveform shown in FIG. 8, a negative voltage is indicated to be above a horizontal axis, i.e., as a positive voltage.

Figure 8:
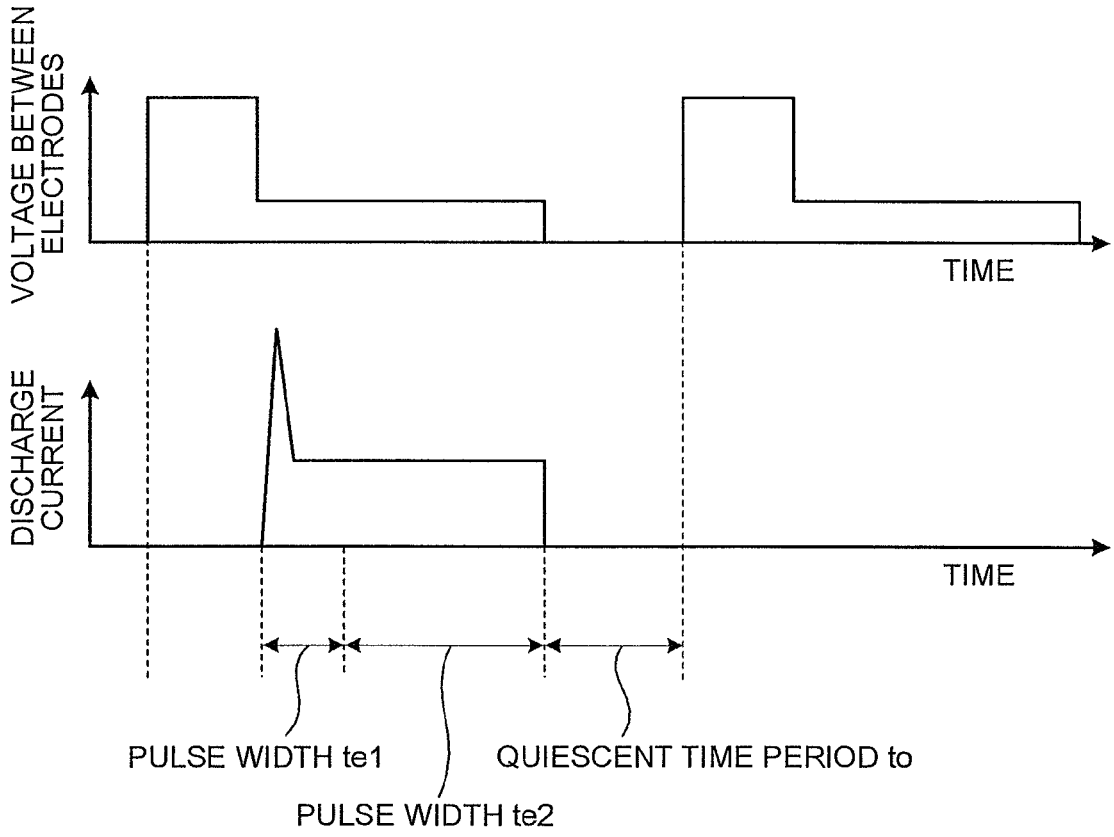
FIG. 8 is a diagram showing an example of parameters of a discharge pulse in the discharge surface treatment.

When a current having such a current waveform is flown, the electrode crumbles due to a current at a high-peaked wave pattern shown in FIG. 8, and a melting can be accelerated by a current at a low-peaked and wide-width wave pattern shown in FIG. 8, so that it is possible to form the coating film on the work 302 at fast speed. In this case, an appropriate current value of a portion of the high-peaked wave pattern is about 10 A to 30 A, and an appropriate current value of a portion of the low-peaked and wide-width wave pattern is about 2 A to 6 A and a discharge duration time (a discharge pulse width) is about 4 μs to 20 μs. If the current at the portion of the low-peaked and wide-width wave pattern is lower than 2 A, it becomes difficult to continuously-output a discharge pulse, and a phenomenon of pulse break-up that a current is broken up in mid-flow often occurs.

Figure 9:
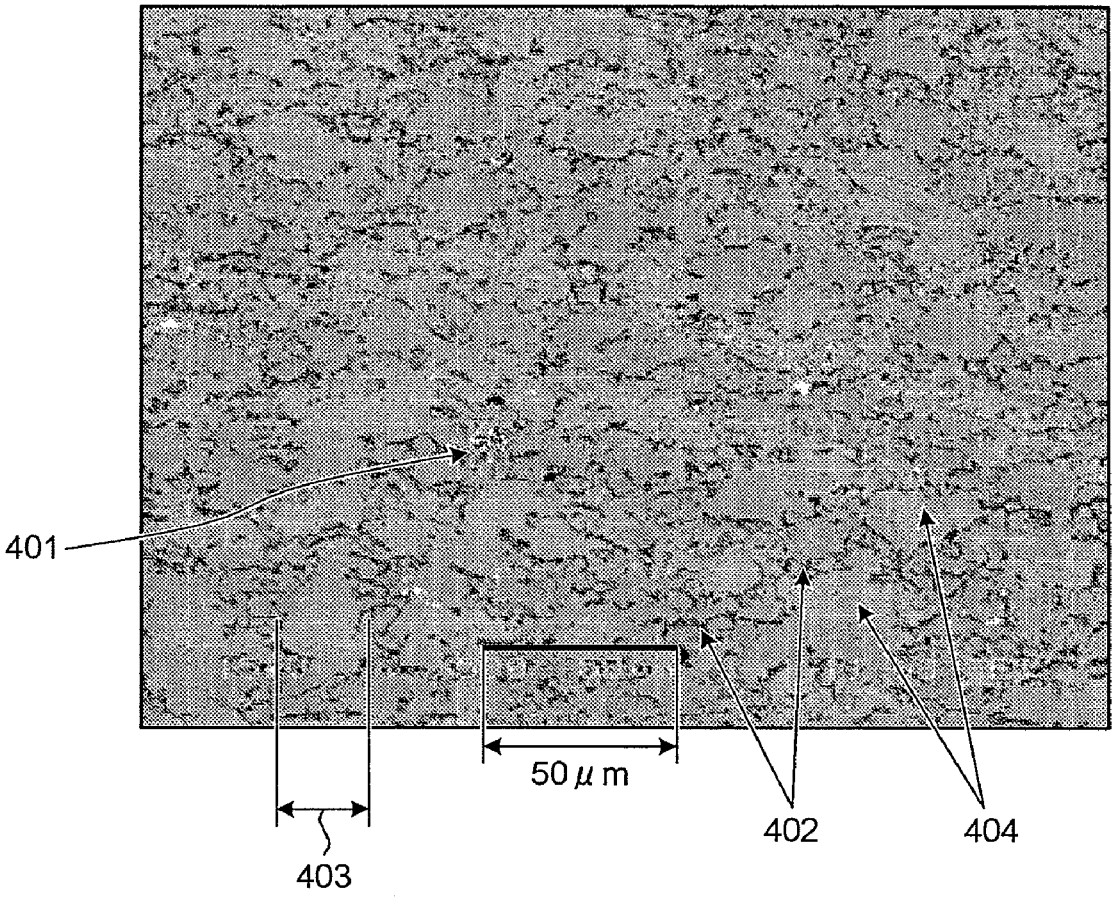
FIG. 9 is a photograph showing a state of a cross section of a coating film according to the present embodiment.

FIG. 9 is an example of a photograph showing a state of a cross section of the coating film according to the present embodiment, which is formed by the above processes. After the coating film is cut, the coating film is ground, and a photograph of the cross section of the coating film is taken with an SEM (Scanning Electron Microscope). Incidentally, the coating film is not etched.

In FIG. 9, white portions and black portions can be seen. The black portions other than holes 401 are not holes, so that a surface of which is ground to be flattened. This can be found by an observation with an optical microscope because the surface looks flat. Furthermore, it can be found by observing with the EPMA that the portions looking black are portions 402 where the concentration of oxygen is high. In the present embodiment, the raw material alloy is the Co alloy mixed with "25 weight % of Cr, 10 weight % of Ni, 7 weight % of W, and Co for the rest" in this ratio, so that in each of the portions 402 where the concentration of oxygen is high, a high concentration of Cr is also observed, and it can be seen that $Cr_2O_3$ (dichromium trioxide), which is an oxide of Cr, is distributed as if the white portions, which is mainly metallic, are filled up with the $Cr_2O_3$.

In FIG. 9, one white portion roughly corresponds to a unit area of a portion of the coating film that the electrode is melted thereinto by a single discharge. Namely, a unit area 403 is an area of a single-discharge crater area that the electrode is melted by a single discharge in the discharge surface treatment. It can be thought that the electrode material is melted, so that the oxide is moved outside a melted block, whereby as shown in FIG. 9, the coating film has such a composition that the portions 402 where the concentration of oxygen is high, which look black through the SEM, i.e., as a portion where the concentration of oxide is high are distributed around cancellous white oxygen-poor portions 404.

A difference between the coating film formed as described above and a coating film formed in such a manner that an oxide is mixed into an electrode in advance as disclosed in International Publication No. WO 2005/068670 pamphlet (an engine part, a high-temperature part, a surface treatment method, a gas-turbine engine, a galling preventive structure, and a method for producing the galling preventive structure) is that the coating film formed as described above is likely to have higher strength without sacrificing for the wear-resistant performance.

If oxide is added until the wear resistance can be improved in the intermediate temperature range (from about 300° C. to about 700° C.), the strength drastically decreases to a fraction of the original strength in a break test of the composition of the coating film. This also leads to lowering of the wear-resistant property in the low temperature range. The reason for this is that, an oxide powder is unevenly distributed in the coating film, so that there are produced portions where the strength is weak, and the composition is easily broken down at those weak portions. In the present embodiment, on the contrary, although oxides are distributed, the strength of the composition is maintained because portions containing a high proportion of a metal are connected to one another.

By the way, it is described above that the appropriate amount of oxygen contained in a powder used for an electrode is within a range of about 6 weight % to about 14 weight %. However, this does not mean that an amount of oxygen within this range is contained in the coating film. FIG. 10 shows an example of a result of measurements of an amount of oxygen contained in a Co alloy powder and an amount of oxygen (and other elements) contained in a coating film formed by using an electrode molded from the Co alloy powder. In FIG. 10, as one example, six different Co alloy powders (No. 1 to No. 6) are considered. Incidentally, the six Co alloy powders are, like the one described above, a Co alloy powder produced in such a manner that a metal in which "25 weight % of Cr, 10 weight % of Ni, 7 weight % of W, and Co for the rest" are mixed in this ratio is dissolved and produced thereinto by the water atomization method.

As can be seen from FIG. 10, in any of the powders, an amount of oxygen is reduced after the Co alloy powder is formed into the coating film. It is appropriate that an amount of oxygen contained in a powder used for an electrode is within the range of about 6 weight % to about 14 weight %. As for the coating film, it is appropriate that an amount of oxygen contained in the coating film is within a range of about 5 weight % to about 9 weight %. Incidentally, numerical values shown in FIG. 10 were a result of measurements obtained with the EPMA, and are values analyzed in an observation area magnified 500 times by an SEM.

When a portion looking white, i.e., an oxygen-poor portion, and a portion looking black, i.e., an oxygen-rich portion in the coating film were analyzed at a larger magnification, an amount of oxygen in each of the white portions was 3 weight % or less, and an amount of oxygen in each of the black portions was mostly 8 weight % or more. Namely, such a composition that an amount of oxygen in the entire coating film is about 5 weight % to 9 weight % and the oxygen-rich portion containing oxygen of 8 weight % or more is distributed around the oxygen-poor portion containing oxygen of 3 weight % or less is suitable for exhibiting the wear-resistant performance in the temperature range from the low temperature range to the high temperature range.

Figures 1, 11:
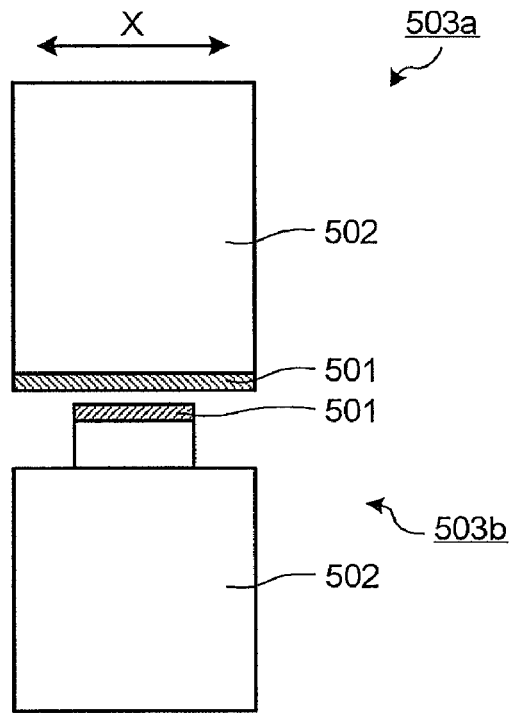
Figures 2, 11:
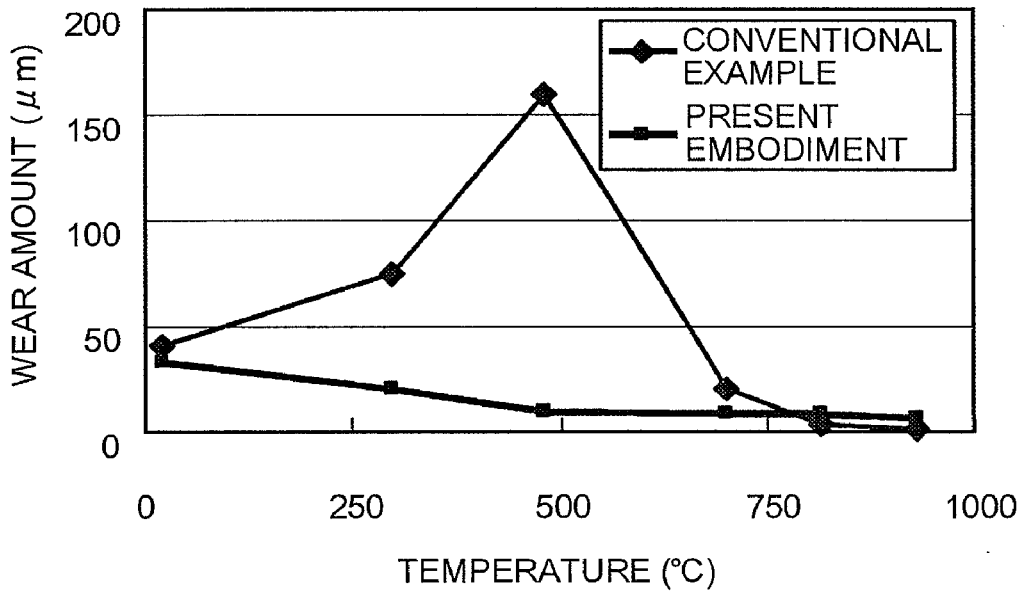
Figures 1, 12:
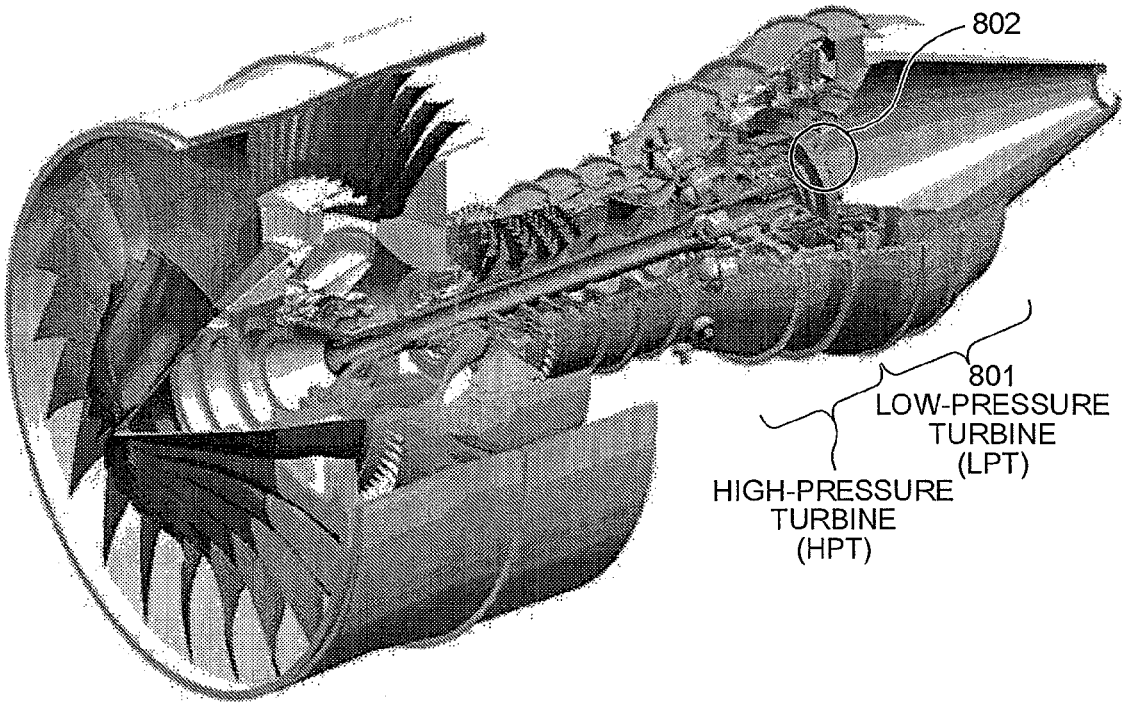
Figures 2, 12:
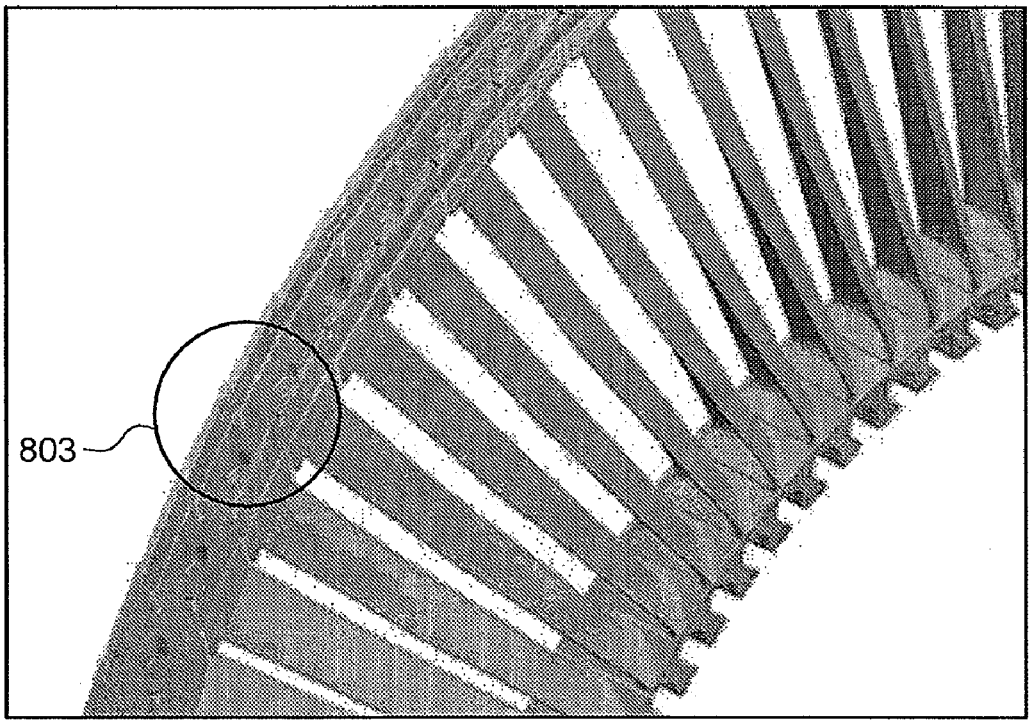
Figures 3, 12:
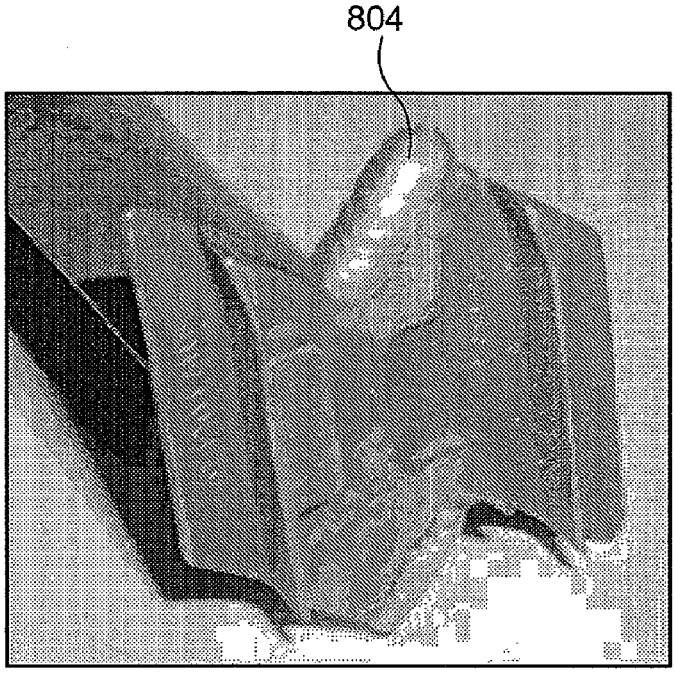
Figure 13:
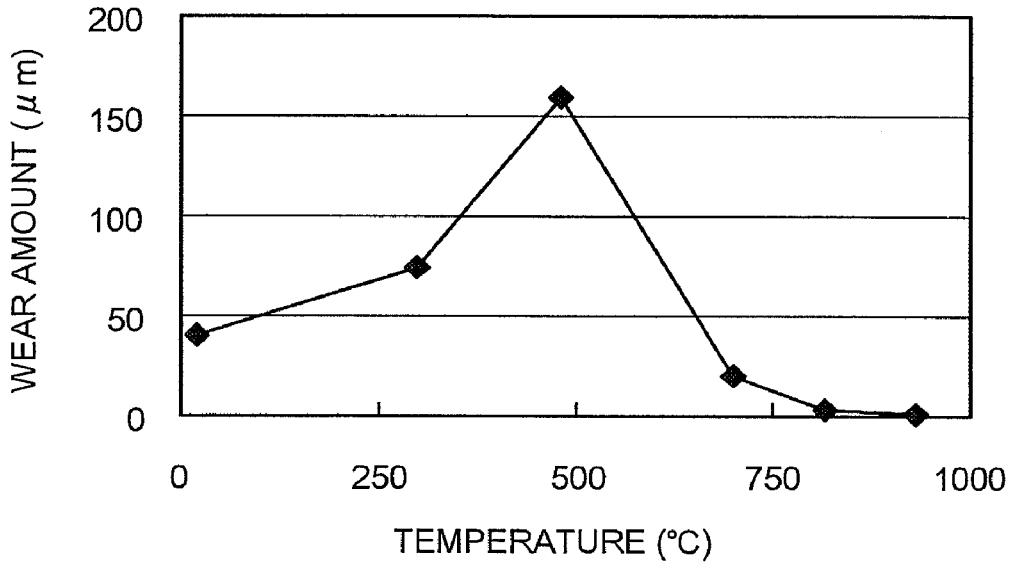
FIG. 13 is a characteristic diagram showing a relation between temperature and wear amount of a test specimen those obtained when a sliding test was conducted with a conventional wear-resistant material.
Figure 14:
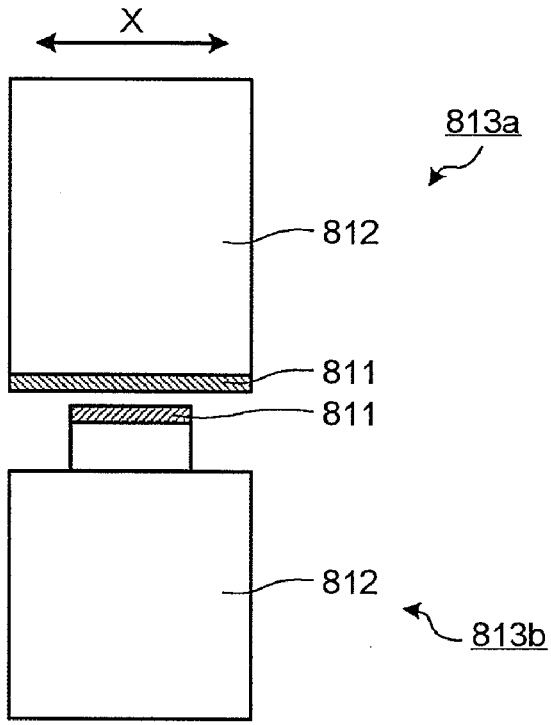
FIG. 14 is a diagram showing a test specimen in which the conventional wear-resistant material is welded to a test-specimen main body by the TIG welding.

Test specimens as shown in FIG. 11-1 were prepared with the coating film according to the present embodiment, and a sliding test was conducted. In the sliding test, first, as shown in FIG. 11-1, the test specimens (an upper test specimen 503*a* and a lower test specimen 503*b*) that a coating film 501 according to the present embodiment is welded to a test-specimen main body 502 by the TIG welding were prepared. Then, the upper test specimen 503*a* and the lower test specimen 503*b* were arranged so that the coating films 501 of which are opposed to each other. The test was conducted under such conditions that a load was applied to each of the upper test specimen 503*a* and the lower test specimen 503*b* so that a surface pressure of which is 3 MPa to 7 MPa, and the upper test specimen 503*a* and the lower test specimen 503*b* were slid by 0.5 mm in width in a reciprocating manner in a direction X shown in FIG. 11-1 through $1\times10^6$ cycles of slide at a frequency of 40 Hz. Incidentally, after each of the coating films according to the present embodiment was welded to the corresponding test-specimen main body 502, the welded portion was ground so that a surface of the coating film 501 is flattened.

FIG. 11-2 shows a result of the sliding test conducted as described above. FIG. 11-2 is a characteristic diagram showing a relation between temperature and wear amount of the test specimens. In the characteristic diagram shown in FIG. 11-2, a horizontal axis indicates temperature of the atmosphere where the sliding test was conducted. The sliding test was conducted in a temperature range of the room temperature to about 900° C. In FIG. 11-2, a vertical axis indicates a total sum of wear amounts of the upper and lower test specimens 503*a* and 503*b* after the sliding test (after $1\times10^6$ cycles of slide). Incidentally, the sliding test was conducted in an unlubricated condition, i.e., in a condition that no lubricating oil is supplied.

From the characteristic diagram shown in FIG. 11-2, it can be found that when the coating film according to the present embodiment is used, a wear amount is low in the temperature range from the low temperature range (about 300° C. or less) to the high temperature range (about 700° C. or more), i.e., the coating film according to the present embodiment has an excellent wear-resistant property. In fact, the wear amount is low in all the temperature ranges, i.e., in any of the low temperature range (about 300° C. or less), the intermediate temperature range (from about 300° C. to about 700° C.), and the high temperature range (about 700° C. or more), so that the coating film according to the present embodiment has an excellent wear-resistant property.

As described above, according to the coating-film forming method according to the present embodiment, it is possible to form a coating film having an excellent wear-resistant property in the temperature range from the low temperature range to the high temperature range without sacrificing for the strength of the coating film.

Incidentally, in the present embodiment, as a powder as a raw material, such a powder that is produced by the water atomization method and an average particle diameter of which is about 20 μm is used. However, the effect of the present embodiment is not limited to a case where the powder produced by the water atomization method is used. Furthermore, the effect of the present embodiment is not limited to the powder having the average particle diameter of 20 μm.

Moreover, in the present embodiment, a Co-base alloy powder produced in such a manner that a metal in which "25 weight % of Cr, 10 weight % of Ni, 7 weight % of W, and Co for the rest" are mixed in this ratio is dissolved is used. However, the present embodiment is not limited to the Co-base metal. Any metal can be used as long as that metal contains an element exhibits a lubricating property when oxidized. In addition, the metal does not always have to be an alloy. However, there is such a case that a material that an oxide of which has a lubricating property, such as Cr, may fail to exhibit the lubricating property depending on a combination of materials, so that it is not preferable to use such a combination of alloy metals.

For example, in a case of an alloy that contains a lot of Ni by mixing Cr with other metals, for example, such a phenomenon that an oxidation of Cr is prevented by a formation of an Ni—Cr intermetallic compound, so that this alloy becomes a material having difficulty in exhibiting the lubricating property occurs. Furthermore, in a case where not an alloy but powders of elements are used, a nonuniformity may occur in an electrode or a coating film due to an uneven distribution of the materials, so that it is necessary to be careful about the mixture.

Furthermore, in the present embodiment, a Co-base alloy powder produced in such a manner that a metal in which "25 weight % of Cr, 10 weight % of Ni, 7 weight % of W, and Co for the rest" are mixed in this ratio is dissolved is used. However, more or less similar results can be obtained with other combinations, for example, a material containing a metal in which an oxide of Cr, Mo, or the like shows a lubricating property, such as a metal in which "28 weight % of Mo, 17 weight % of Cr, 3 weight % of Si, and Co for the rest", or "20 weight % of Cr, 10 weight % of Ni, 15 weight % of W, and Co for the rest" are mixed is dissolved.

Moreover, in the present embodiment, there is given an example in which a Co alloy powder that is produced by the water atomization method and an average particle diameter of which is about 20 μm is ground by the swirling jet mill. However, a type of the jet mill is not limited to the swirling jet mill. For example, there are other types of jet mills, such as an opposed jet mill that grinds a powder by blowing off the powder from two directions opposed to each other so that powder particles collide with one another, a colliding type one that grinds a powder by colliding the powder with a wall surface or the like. It goes without saying that as long as a powder can be ground into a powder described above, any types of jet mills can be used.

In a process of grinding a powder with the jet mill, not only an alloy powder is pulverized into a fine powder, but also it takes on such a major significance that the powder is uniformly oxidized. Therefore, it is necessary to perform the pulverization in the oxidant atmosphere, such as the atmosphere. In general, when a metal powder is ground, it is common to pay attention not to oxidize the powder as far as possible. For example, when the jet mill is used, the oxidization of the powder is prevented by using nitrogen as the high-pressure atmosphere used in the pulverization. Furthermore, in a case of a ball mill or a vibration mill that employs other grinding method, a powder is ground while mixing with a solvent, and the ground powder is commonly prevented from being in contact with oxygen as far as possible.

However, in the present invention as described above, it is imperative to oxidize a ground powder. A tool for oxidizing the powder is not limited to the jet mill. If a mill employing other grinding method, such as a ball mill or a vibration mill, can grind a powder while oxidizing the powder, the same effect as the jet mill can be obtained. However, the ball mill or the vibration mill gets a pot containing the powder into a sealed condition, so that it is necessary to create an easily-oxidizable environment, for example, by opening the pot at regular intervals. Therefore, the ball mill or the vibration mill is disadvantageous in that it is difficult to manage a state of oxidation and a fluctuation in quality easily occurs.

Furthermore, as described above, the ball mill or the vibration mill generally grinds a powder by mixing the powder with a solvent, in most cases. However, in a state where the powder is mixed with the solvent, an oxidation of the powder is scarcely advanced in the grinding process. Therefore, when the powder was ground without any solvent as a trial, it was difficult to handle the process because there were such problems that a container produced heat, and the powder was attached to balls.

Moreover, when a powder is ground while mixing with a solvent, an oxidation of the powder is advanced at a burst in a phase of drying after the pulverization. Therefore, it is necessary to select an optimum condition by changing an oxygen concentration in the ambient atmosphere and a drying temperature during the drying. As compared with the pulverization with the ball mill or the vibration mill, it is relatively easy to handle the pulverization with the jet mill because an amount of oxygen contained in the ground powder, i.e., a degree of oxidation is almost determined by a particle diameter of the ground powder, so that the degree of oxidation can be controlled by controlling the particle diameter.

In either case, an important thing in the present invention is to contain a predetermined amount of oxygen in a powder. If this is possible, a powder needs not always to be ground. The almost same effect as the case where a powder is ground was obtained in such an experiment by the inventors that a powder atomized by high pressure is classified, and thereby producing a powder having a particle diameter of about 1 μm, and then the powder is oxidized by heat. However, at present, the oxidation by heat has still difficulty adjusting a degree of oxidation, and there is a problem in yield.

Furthermore, in the present embodiment, as a method of molding a powder, a compression molding by a press is used. As a press pressure, molding pressure of about 100 MPa to 300 MPa is applied. However, the pressure by the press significantly varies depending on a state of the powder, so that the pressure is not necessarily limited to this range. For example, the untouched powder is not pressed, but the powder is granulated in advance, so that the powder can be uniformly molded even at low pressure.

Furthermore, it is possible to produce an electrode having the similar characteristics in such a manner that within certain ranges, the molding pressure is reduced and the heating temperature is increased, conversely, the molding pressure is increased and the heating temperature is reduced. Moreover, if a hot pressing method or an SPS (spark plasma sintering) method is employed, it is possible to produce an electrode even at low press pressure and low heating temperature. In addition, a powder can be molded by a metal injection molding or a slurry method instead of the compression molding by the press.

As described above, in the present embodiment, there is described such an example that a coating film is formed by a discharge surface treatment with a pulsed discharge. However, an essential portion of the invention, which is required to exhibit the effect of the wear-resistant performance explained in the present embodiment, is that a metal containing a metal material exhibiting a lubricating property when it is oxidized is made into a powder, the powder is prepared (oxidized) so as to contain a predetermined amount of oxygen, and the powder is dissolved so that an oxide is moved outside the powder thereby creating a distribution of oxygen concentration, and then the powder is attached and deposited onto a material subject to the treatment.

Incidentally, for this purpose, an experiment by the inventors showed that the similar effect can be obtained by spraying if certain conditions are met. In the image shown in FIG. 9, which shows the cross section of the coating film formed by the discharge surface treatment, there were observed the oxygen-poor portions and the oxygen-rich portions, and one block of the oxygen-poor portions was a portion melted by a single discharge energy. The portion melted by the single discharge energy is formerly a lot of powders, and the powders are melted and held together into one.

On the other hand, to create the similar effect by the spraying, the spraying was performed in such a manner that a powder having a particle diameter of about a few dozen μm is melted in the oxidant atmosphere, i.e., in the atmosphere and sprayed on a material subject to the treatment. With this method, in a state where, in a unit of about the same size as the particle diameter of the used powder, an oxygen-rich portion containing oxygen of 8 weight % or more is distributed around an oxygen-poor portion containing oxygen of 3 weight % or less, and an amount of oxygen contained in the entire coating film is about 5 weight % to 9 weight %, a performance close to that of the coating film according to the present embodiment was obtained. However, in the case of the spraying, an adhesive force acting between the coating film and the material subject to the treatment is weak, and a strength of the coating film is also weak. Therefore, a wear-resistant performance of the coating film produced by the spraying does not come up to the wear-resistant performance of the coating film according to the present embodiment shown in FIG. 9. If oxygen content is above this range, the coating film goes into a tattered weak state. If oxygen content is below this range, a material exhibiting a lubricating property is not enough, so that a sufficient wear-resistant performance cannot be obtained.

INDUSTRIAL APPLICABILITY

In this manner, the coating-film forming method according to the present invention is useful in a field requiring a wear-resistant property in a wide temperature range from low temperature to high temperature.

The invention claimed is:

1. A coating-film forming method comprising:

a metal-powder producing step of producing a metal powder containing an element exhibiting a lubricating property when oxidized and comprising a mixture of chromium (Cr), nickel (Ni), tungsten (W), and cobalt (Co);

an oxidizing step of oxidizing the metal powder to produce an oxidized metal powder, the amount of oxygen contained in the oxidized metal powder is within 6 weight % to 14 weight %; and a coating-film forming step of forming a coating film from the oxidized metal powder on a material subject to a treatment, the coating film having such a composition that an area where an oxygen content is 3 weight % or less and an area where an oxygen content is 8 weight % or more are distributed in a unit area of the coating film, and an oxygen content of the entire coating film is within 5 weight % to 9 weight %.

2. The coating-film forming method according to claim 1, wherein the oxidizing step includes a step of grinding the metal powder in an oxidant atmosphere to produce the oxidized metal powder.

3. The coating-film forming method according to claim 2, further comprising a compact producing step of producing a compact by molding the oxidized metal powder, wherein the coating-film forming step includes:

generating a pulsed discharge between the compact and the material subject to treatment in a working fluid or in an atmosphere;

putting the oxidized metal powder composing the compact into a melted state or a semi-melted state with an energy of the pulsed discharge; and forming on the material subject to treatment the coating film having such a composition that an area where an oxygen content is 3 weight % or less and an area where an oxygen content is 8 weight % or more are distributed in a unit area of the coating film.

4. A coating film obtained from a metal powder, the metal powder obtained from a powder containing an element exhibiting a lubricating property by oxidation thereof and comprising a mixture of chromium (Cr), nickel (Ni), tungsten (W), and cobalt (Co), wherein the coating film has such a composition that an area where an oxygen content is 3 weight % or less and an area where an oxygen content is 8 weight % or more are distributed in a unit area of the coating film, and an oxygen content of the entire coating distributed in a unit area of the coating film, and an oxygen content of the entire coating film is 5 weight % to 9 weight %.

5. The coating film according to claim 4, wherein the unit area is a single-discharge crater area obtained when a pulsed discharge is generated between a compact, which is composed of the metal powder, and a material subject to a treatment in a working fluid or in an atmosphere, and the metal powder composing the compact is put into a melted state or a semi-melted state by an energy of the pulsed discharge.

6. The coating-film forming method according to claim 1, wherein after forming the coating film on the material subject to a treatment, and before the formed coating film is heated above 300° C. in use, the coating film has an area where an oxygen content is 3 weight % or less and an area where an oxygen content is 8 weight % or more distributed in a unit area of the coating film.

7. The coating-film forming method according to claim 1, wherein after forming the coating film on the material subject to a treatment, and before the formed coating film is heated above 300° C. in use, the oxygen content of the entire coating film is within 5 weight % to 9 weight %.

8. The coating film according to claim 4, wherein before the coating film is heated above 300° C., the coating film has an area where an oxygen content is 3 weight % or less and an area where an oxygen content is 8 weight % or more distributed in a unit area of the coating film.

9. The coating film according to claim 4, wherein before the coating film is heated above 300° C., the oxygen content of the entire coating film is within 5 weight % to 9 weight %.

* * * * *